US010202712B2

(12) United States Patent
Baum et al.

(10) Patent No.: US 10,202,712 B2
(45) Date of Patent: Feb. 12, 2019

(54) PRODUCING SPINNABLE AND DYEABLE POLYESTER FIBERS

(75) Inventors: Pia Baum, Weinheim (DE); Klaus Scheuermann, Limburgerhof (DE)

(73) Assignee: BASF SE (DE)

( * ) Notice: Subject to any disclaimer, the term of this patent is extended or adjusted under 35 U.S.C. 154(b) by 580 days.

(21) Appl. No.: 13/387,768

(22) PCT Filed: Jul. 27, 2010

(86) PCT No.: PCT/EP2010/060843

§ 371 (c)(1),
(2), (4) Date: Mar. 27, 2012

(87) PCT Pub. No.: WO2011/012598

PCT Pub. Date: Feb. 3, 2011

(65) Prior Publication Data

US 2012/0180232 A1 Jul. 19, 2012

(30) Foreign Application Priority Data

Jul. 31, 2009 (EP) ..... 09166985

(51) Int. Cl.
*D01F 6/92* (2006.01)
*D01F 1/10* (2006.01)
*D06P 3/36* (2006.01)

(52) U.S. Cl.
CPC ..... *D01F 6/92* (2013.01); *D01F 1/10* (2013.01); *D06P 3/36* (2013.01)

(58) Field of Classification Search
CPC ..... D01F 6/92; D01F 1/10; D06P 3/36
USPC ..... 8/922, 930, 494
See application file for complete search history.

(56) References Cited

U.S. PATENT DOCUMENTS

| | | | | |
|---|---|---|---|---|
| 3,652,714 A | | 3/1972 | Berger | |
| 4,167,541 A | | 9/1979 | Alexander | |
| 4,994,089 A | | 2/1991 | Bartkowiak et al. | |
| 5,509,940 A | * | 4/1996 | Zbar et al. | 8/617 |
| 6,120,895 A | | 9/2000 | Kowitz et al. | |
| 6,497,950 B1 | * | 12/2002 | Haile et al. | 428/364 |
| 2007/0179253 A1 | * | 8/2007 | Matsuoka et al. | 525/438 |
| 2008/0042312 A1 | | 2/2008 | Chen et al. | |
| 2010/0035497 A1 | * | 2/2010 | Sierakowski et al. | 442/171 |
| 2011/0154582 A1 | | 6/2011 | Baum et al. | |
| 2011/0196098 A1 | | 8/2011 | Mettlach et al. | |

FOREIGN PATENT DOCUMENTS

| | | | | |
|---|---|---|---|---|
| CN | 1376724 A | | | 10/2002 |
| EP | 0 364 792 A2 | | | 4/1990 |
| EP | 1 217 024 A1 | | | 6/2002 |
| GB | 769405 A | | | 3/1957 |
| JP | 8074124 A | | | 3/1996 |
| KR | 10-1995-0023663 | | | 8/1995 |
| KR | 0132155 | | | 4/1998 |
| WO | WO 98/12242 | | | 3/1998 |
| WO | WO-2004/078844 A1 | | | 9/2004 |
| WO | WO 2008/065185 | | * | 6/2008 |
| WO | WO-2008065185 A2 | | | 6/2008 |
| WO | WO-2009/021967 A1 | | | 2/2009 |
| WO | WO-2010/018073 A1 | | | 2/2010 |
| WO | WO-2010079030 A2 | | | 7/2010 |

OTHER PUBLICATIONS

International Search Report for PCT/EP2010/060843 dated Jan. 13, 2011.
International Preliminary Report on Patentability of PCT/EP2010/060843 dated Jan. 31, 2012.
English Translation for Korean Office Action for Application No. 10-2012-7002503, dated Jul. 11, 2016.

* cited by examiner

*Primary Examiner* — Amina S Khan
(74) *Attorney, Agent, or Firm* — Drinker Biddle & Reath LLP

(57) ABSTRACT

The present invention relates to a process for producing dyed polyester fibers (C) from a terephthalate polyester (A), at least one polyester-containing additive (B) and optionally at least one component (G). The polyester-containing additive is obtainable by condensation of the monomers of an aliphatic 1,ω-diol, of an aliphatic 1,ω-dicarboxylic acid and of an aromatic 1,ω-dicarboxylic acid. Optionally, chain extenders (V) are also used in the production of the polyester-containing additive (B). For fiber production, the components (A), (B) and optionally (G) are mixed, melted in an extruder and extruded through spinneret dies. These polyester fibers (C) are preferably used in the production of dyed textile fabrics (F).

17 Claims, No Drawings

PRODUCING SPINNABLE AND DYEABLE POLYESTER FIBERS

CROSS-REFERENCE TO RELATED APPLICATIONS

This application is a national stage application (under 35 U.S.C. § 371) of PCT/EP2010/060843, filed Jul. 27, 2010, which claims benefit of European application 09166985.3, filed Jul. 31, 2009.

The present invention relates to a process for producing spinnable and dyeable polyester fibers from a terephthalate polyester and at least one polyester-containing additive.

Polyesters (PESs) are polymers having ester bonds —[—CO—O—]— in their main chain. The term polyester is today understood as referring to that large family of synthetic polymers which includes polyethylene terephthalate (PET) and polybutylene terephthalate (PBT) among others. PET is one of the most important thermoplastic polyesters. It is used in fibers (microfibers) for textiles and nonwovens for example.

PES fibers are produced by the melt-spinning process. A melt is formed by heating and extruded through spinneret dies. PES fibers are usually dyed by using disperse dyes, comprising pigments in a mostly aqueous formulation. PES fibers are generally dyed by the exhaust or thermosol process at temperatures of 130° C. or more. When a PES material is to be dyed at a lower temperature, for example in order to dispense with pressure vessels, a chemical compound known as a carrier has to be additionally used to facilitate the penetration of the dye into the fiber at lower temperatures. An example of a carrier for dyeing PES materials is described in EP 0 364 792 B1.

JP-A 8074124 reports the production of a readily dyeable polybutylene terephthalate fiber obtained by copolymerization with a comonomer of 0.5 to 5 mol %, based on all acid moieties in the fiber, of a sodium salt of sulfoisophthalic acid, 15 to 85 ppm of titanium and 0.02% to 2.0% by weight of the antioxidant phenol (hypo)phosphite. The fiber is dyeable with cationic dyes which bind to the comonomer.

EP 1 217 024 B1 reports spinnable and dyeable polyester resins such as polybutylene terephthalate. The polyester here is constructed from an alkylendiol, terephthalic acid and a complex comonomer which may comprise a metal or alkylphosphonium sulfone, trivalent aromatic rings and functional ester groups. The polymerization utilizes a titanium catalyst. The incorporated comonomer is also the receptor site for a cationic dye. Dyeing takes place at 100° C.

Prior art PES fibers dyeable at around 100° C. thus require either the use of carriers or the use of PES copolymers which have to be prepared via complex polymerization steps. A further problem in polyester production and/or further processing is that fibers comprising complex copolymers can have higher spinnability requirements or allow little variation in fiber thickness, fibers are inflexible and particularly that even standard polyester fibers need very high temperatures for their dyeings to be light- and washfast.

SUMMARY OF THE INVENTION

It is an object of the present invention to provide a process for producing a PES material (for example from polyethylene terephthalate or polybutylene terephthalate as base polyester) wherein the PES material produced does not include any complex polymerization steps in its production, has good spinning properties and the PES material produced can be dyed light- and washfast at below 130° C., preferably at around or below 100° C. without a carrier.

We have found that this object is achieved by a process for producing dyed polyester fibers (C), dyed yarn (E) and/or dyed textile fabric from the components a) 80% to 99% by weight, based on the sum total of all the constituents of the fibers, of at least one terephthalate polyester (A), b) 1% to 20% by weight, based on the sum total of all the constituents of the fibers, of at least one polyester-containing additive (B) obtainable from the monomers m m1) aliphatic 1,ω-diol, m2) aliphatic 1,ω-dicarboxylic acid, m3) aromatic 1,ω-dicarboxylic acid, and optionally at least one chain extender (V), and c) optionally at least one component (G)

comprising the steps of

I) mixing the components (A), (B) and, if used, (G),

II) producing polyester fibers (C) from the mixture obtained in step I),

III) optionally further processing the polyester fibers (C) into yarn (E) and/or textile fabric (F), and IV) dyeing the polyester fibers (C), the yarn (E) and/or the textile fabric (F) at a temperature of <130° C.

A DETAILED DESCRIPTION OF THE INVENTION

Producing PES fibers in the manner of the present invention, which comprises melting more particularly PBT or PET and at least one polyester-containing additive (B), does not require any complex polymerization operations but merely comprises two or more components, i.e., at least (A) and (B), being mutually mixed and melted and the melt being spun with the addition of the polyester-containing additive (B) frequently even facilitating the melt-spinning operation.

Dyeing polymer compositions comprising at least one of the recited polyester-containing additives (B) in addition to standard polyesters, such as PET or PBT, can be effected by using a disperse dye in the manner of an exhaust process at below 130° C. and even at just 100° C.

The polyester fibers, yarns and textile fabrics produced by the process of the present invention are notable for intensive and uniform dyeability. They further have a wide useful color spectrum, good rubfastnesses and very good washfastnesses.

Compared with prior art polyester fibers, which require temperatures of 130° C. or higher to be dyeable without major equipment requirements, the use of the present invention polyester fiber (C) for the dyeing operation represents a technical simplification in terms of machinery. In addition, energy requirements are reduced and time is saved. Furthermore, the process of the present invention is gentle on the material to be dyed. The polyester fibers (C) are as supple and smooth after dyeing as before.

The invention will now be described in detail:

Step (I) comprises mixing the components (A), (B) and, if used, (G). According to the present invention, this is preferably done in the melt. In step (II), polyester fibers (C) are produced from the mixture obtained in step (I). According to the present invention, the polyester fibers (C) are preferably produced by the mixture obtained in step (I)

being melted in an extruder, extruded through spinneret dies and wound up. The fibers obtained in the process are still undyed.

If desired, the polyester fibers (C) can be further processed in step (III) to form yarn (E) and/or textile fabrics (F) before the polyester fibers (C) or alternatively the yarn (E) or textile fabric (F) produced therefrom is dyed at a temperature <130° C. In one embodiment of the invention, the polyester fibers (C) are spun into a yarn (E) in step (III). The yarn (E) or the polyester fibers (C) can also be used in step (III) to produce a textile fabric (F) before the dyeing is carried out in step (IV). It will be appreciated that the fibers can also be first dyed and subsequently further processed into yarn (E) and/or textile fabrics (F), or alternatively for the undyed polyester fibers (C) to be used to first fabricate a yarn (E) which is first dyed and then made into a textile fabric.

First, undyed fibers consisting essentially of polyester are produced by intensive mixing of the components, terephthalate polyester (A) and at least one polyester-containing additive (B) and optionally one or more components (D), in the melt and subsequent spinning.

The undyed polyester fibers (C) produced comprise very substantially a terephthalate polyester (A) as main component and also at least one polyester-containing additive (B), although in a further preferred embodiment, (B) prior to fiberization may comprise up to 7% by weight, based on the sum total of all the constituents of the respective component, of at least one chain extender (V), which is 1,6-hexamethylene diisocyanate in particular.

In a particularly preferred embodiment, the terephthalate polyester (A) is selected from polyethylene terephthalate (PET) or polybutylene terephthalate (PBT). The polyester fibers (C) preferably comprise PBT or PET at 80 to 99%, particularly preferably PET is used, particularly preferably a polyester consisting of terephthalic acid and ethylene glycol is used as textile fiber. An example of a commercially available PBT is Ultradur B 4520® from BASF SE of Ludwigshafen. The terephthalate polyester (A) generally comprises a polyester having a melting point in the range from 200 to 280° C.; a further example is textile fibers such as e.g. Dralon from Trevira.

The polyester-containing additives (B) are obtainable from monomers m having at least two different dicarboxylic acid units m2) and m3). This totality of the monomers m comprises for example at least 5 to 80% of phthalic acid units and also 20 to 95% of units derived from aliphatic 1,ω-dicarboxylic acids having 4 to 10 carbon atoms, based on the total weight of the polyester-containing additive (B). In a further, preferred embodiment of the invention, the monomers m1):m2):m3) are present in a molar ratio of 2:1:1.

The polyester-containing additives (B) used according to the present invention to produce the polyester fibers (C) comprise at least the carboxylic acids described and a diol unit.

The polyester-containing additive (B) is prepared by subjecting the monomers m to a polymerization step. It may happen that a certain amount of monomer is present in the polyester-containing additive (B) in an unpolymerized, i.e., "free", state, and this may have an influence on the polyester fiber (C) produced from (B).

The total amount of carboxylic acid units m2) and m3) which are comprised in the polyester-containing additive (B) in a free or polymerized state is at least 50%.

In a preferred embodiment, the aromatic 1,ω-dicarboxylic acid m3) is terephthalic acid.

The aliphatic 1-ω-dicarboxylic acids m2) may comprise for example succinic acid, glutaric acid, adipic acid or sebacic acid. In a particularly preferred embodiment of the invention, the aliphatic 1,ω-dicarboxylic acid m2) is adipic acid.

In an exemplary embodiment of the invention, the amount of terephthalic acid units and adipic acid units is 1:1. The diols m1) are selected from the group consisting of aliphatic, cycloaliphatic and/or polyether diols provided not more than 52% of aliphatic 1,ω-diols are present and the percentages are based on the totality of all diols present in the polyester-containing additive in a free or esterified state.

The aliphatic diols having 4 to 10 carbon atoms may comprise for example 1,4-butanediol, 1,5-pentanediol or 1,6-hexanediol. In an advantageous embodiment of the invention, the aliphatic 1,ω-diol m1) is 1,4-butanediol.

The polyester-containing additive (B) may be prepared using at least one chain extender (V). The at least one chain extender (V) is customarily selected from compounds comprising at least three groups capable of ester formation (V1) and from compounds comprising at least two isocyanate groups (V2).

The compounds V1 preferably comprise from three to ten functional groups capable of forming ester bonds. Particularly preferred compounds V1 have from three to six functional groups of this kind in the molecule, more particularly from three to six hydroxyl groups and/or carboxyl groups. Specific examples are:

tartaric acid, citric acid, malic acid; trimethylolpropane, trimethylolethane; pentaerythritol; polyether triols; glycerol; trimesic acid; trimellitic acid, trimellitic anhydride; pyromellitic acid, pyromellitic dianhydride and hydroxyisophthalic acid.

The compounds V1 are generally used in amounts of 0.01 to 15, preferably 0.05 to 10, and more preferably from 0.1 to 4 mol %, based on the components m2 and m3.

Component V2 comprises an isocyanate or a mixture of different isocyanates. Aromatic or aliphatic diisocyanates can be used. However, higher-functional isocyanates can also be used.

An aromatic diisocyanate V2 for the purposes of the present invention comprises in particular tolylene 2,4-diisocyanate, tolylene 2,6-diisocyanate, 2,2'-diphenylmethane diisocyanate, 2,4'-diphenylmethane diisocyanate, 4,4'-diphenylmethane diisocyanate, naphthylene 1,5-diisocyanate or xylylene diisocyanate.

Of these, 2,2'-, 2,4'- and 4,4'-diphenylmethane diisocyanates are particularly preferred for use as component V2. In general, the latter diisocyanates are used in the form of a mixture.

A useful trinuclear isocyanate V2 is tri(4-isocyanophenyl) methane. Polynuclear aromatic diisocyanates are generated for example in the course of the production of a mono- or dinuclear diisocyanates.

Component V2 may also comprise minor amounts, for example up to 5% by weight, based on the total weight of component V2, of urethione groups, for example for capping the isocyanate groups.

An aliphatic diisocyanate V2 for the purposes of the present invention comprises in particular linear or branched alkylene diioscyanates or cycloalkylene diisocyanates having 2 to 20 carbon atoms, preferably 3 to 12 carbon atoms, for example 1,6-hexamethylene diisocyanate, isophorone diisocyanate or methylenebis(4-isocyanatocyclohexane). Particularly preferred aliphatic diisocyanates V2 are 1,6-hexamethylene diisocynate and isophorone diisocyanate.

Preferred isocyanurates include aliphatic isocyanurates derived from alkylene diisocyanates or cycloalkylene diisocyanates having 2 to 20 carbon atoms, preferably 3 to 12 carbon atoms, for example isophorone diisocyanate or methylenebis(4-isocyanatocyclohexane). The alkylene diisocyanates may be linear or branched. Particular preference is given to isocyanurates based on n-hexamethylene diisocyanate, for example cyclic trimers, pentamers or higher oligomers of n-hexamethylene diisocyanate.

In general, component V2 is used in amounts of 0.01 to 5, preferably 0.05 to 4 mol % and more preferably 0.1 to 4 mol %, based on the sum total of the molar amounts of m1, m2 and m3.

The glass transition temperature at which amorphous or crystalline polymers transition from the hard elastic or glassy state into the liquid or rubbery state is referred to as Tg value (in degrees C.). A standard PES material has a Tg value of about 80° C.

In a particularly preferred embodiment of the invention, the Tg value of the polyester-containing additive (B) is between −50 and 0° C., preferably between −45 and −10° C. and more preferably between −40 and −20° C.

Admixing the polyester-containing additive (B) to the terephthalate polyester (A) and the associated production of polyester fibers (C) having a reduced softening point makes dyeing at <130° C., preferably ≤120° C., more preferably ≤110° C., even more preferably ≤100° C. and especially preferably ≤90° C. possible. A reduced glass transition temperature is associated with an increased mobility into the PES chains; at the same time, any colorant added penetrates preferentially into these soft segments of the fiber. The net outcome is an intensive color.

Distributing the polyester-containing additive (B) in the terephthalate polyester (A) takes place uniformly and without droplets. The fibers obtained are readily spinnable at particularly high speeds. Depending on the desired use in a textile fabric (F) to be subsequently produced therefrom, different fiber linear densities can be spun. Compatibilizers (R) can optionally be added for optimal mixing of (A) and (B).

In step (I) of the process of the present invention, the components (A) and (B) may additionally be mixed with one or more components (G). The component(s) (G) comprise(s) processing assistants such as lubricants, processing aids and waxes, additives such as compatibilizers, UV stabilizers, photostabilizers, thermal stabilizers, dyes and pigments, flame retardants, antioxidants, plasticizers, metal oxides such as, for example, titanium oxides, optical brighteners and fillers. Its or their proportion is generally in the range from 0% to 20% by weight and preferably in the range from 0% to 10% by weight, based on the total weight of the mixture obtained in step (I), or of the undyed fibers produced therefrom, these comprising at least 0.1% by weight of component (G), if present.

In the process of the present invention, the polyester-containing additive (B) preferably has a number average molecular weight $M_n$ in the range from 50 000 to 300 000 g/mol or of 50 0000 to 180 000 g/mol.

Preparing the polyester-containing additive (B) used according to the present invention, typical reaction conditions and catalysts are known in principle to a person skilled in the art. The dicarboxylic acids m2) and m3) used for preparing (B) can be used, in a manner known in principle, as free acids or in the form of customary derivatives such as esters for example. Typical esterification catalysts can be used. It is optionally also possible to use chain extenders (V), such as HMDI (1,6-hexamethylene diisocyanate), in the preparation of (B). In an advantageous version of the reaction, polyester diol units can also initially be presynthesized and then linked to each other by means of a chain extender (V). By choosing the building blocks and/or the reaction conditions, a person skilled in the art is readily able to conform the properties of the polyesters to any particular requirement profile.

It will be appreciated that a mixture of two or more different polyester-containing additives (B) can also be used.

According to the present invention, the undyed polyester fibers (C) comprise from 1% to 20% by weight, preferably from 5% to 10% by weight and, for example, 6% by weight of at least one such polyester-containing additive (B), based on the sum total of all the constituents of the undyed fiber.

Process Steps

Undyed fibers consisting essentially of polyester are produced by intensive mixing of at least the terephthalate polyester (A) and the polyester-containing additive (B) by mixing, melting and spinning.

To this end, terephthalate polyester (A) and polyester-containing additive (B) are preferably metered into the mixing assembly using appropriate metering devices as granules for example. It will be appreciated that it is also possible to use a granular premix.

The components (A) and (B) and also optionally further polymers and/or admixtures and auxiliaries (component (D)) are intensively mixed with one another by means of suitable apparatuses, initially by heating up to the point of melting. Kneaders, single-screw extruders, twin-screw extruders or other mixing or dispersing apparatuses can be used for example. Preference is given to using single-screw extruders, since homogeneous commixing can be achieved even in a single-screw extruder through length and type of screw, temperature and residence time in the extruder.

The mixing temperature is chosen by a person skilled in the art and depends on the nature of the components (A) and (B). The terephthalate polyester (A) and the further polyester-containing additive (B) shall, on the one hand, soften sufficiently for commixing to be possible. On the other hand, they must not become too thinly liquid or sufficient input of shearing energy is no longer possible and in certain circumstances there is also a risk of thermal degradation. In general, mixing is carried out at a product temperature of 250° C. to 290° C., preferably at 280° C., without the invention being limited thereto.

After mixing, the melt is extruded to obtain the undyed polyester fiber (C) which is subsequently wound up directly. In effect, the molten mass is forced in a manner known in principle through one or preferably more than one die, such as a hole die, for example a 24 hole die equipped with a normal screen, and a die pressure of for example 28 to 32 bar to form appropriate polyester fibers (C) (filaments). A regulator temperature of 280° C. will prove advantageous for the direct spinning of the mixtures used according to the present invention. The fibers or to be more precise filaments should generally have a diameter of less than 0.7 μm. The diameter is preferably in the range from 0.5 to 0.2 μm without the invention being limited thereto. In general, the polyester fibers (C) consist of a plurality of filaments having overall yarn linear densities in the range from 125 to 127 dtex (dtex=g/10 km of fiber). It is also possible, as will be appreciated, to produce overall yarn linear densities in the range from 1 to 300 dtex.

In an advantageous embodiment, the settings are for example extruder speed 50 rpm, godet speed 300 rpm and windup speed 600 rpm. Hotplate temperature is for example 100° C. for a draw ratio of 1:2 (50:100 m/min).

The polyester fibers (C) produced according to the present invention by the process described above can also be processed into textile fabrics (F) and dyed. The polyester fibers (C) can also be first dyed and then further processed into yarn (E) and/or textile fabrics (F). It is also possible first to produce yarn (E) from the polyester fibers and to dye it. The dyed yarn (E) may then optionally be used to produce textile fabric (F).

In a preferred embodiment of the invention, the polyester fibers (C), the yarn (E) and/or the textile fabric (F) are treated with a stabilizing emulsifier prior to being dyed.

The process of the present invention is notable in particular for the process for producing a dyed textile fabric (F) proceeding from polyester fiber (C) preferably comprising the steps of d) spinning the polyester fiber (C) to form a yarn (E),
e) further processing the yarn (E) to form a textile fabric (F),
f) treating the textile fabric (F) with a stabilizing emulsifier,
g) dyeing the textile fabric (F).

To this end, the undyed polyester fibers (C) are spun for example a second time to obtain a yarn (E) therefrom. The yarn (E) can subsequently be processed, for example on a circular knitting machine, to form a textile fabric (F) in line with process step e). Processes for producing textile fabrics (F) from fibers (C) or yarns (E) are known in principle to a person skilled in the art.

The undyed polyester fibers (C), yarns (E) and textile fabrics (F) are pretreated by treating them with surfactants, for example consisting of an anionic surfactant and a nonionic surfactant, at a liquor ratio (weight ratio of dye formulation to textile material) of for example 20:1 at elevated temperature. A stabilizing emulsifier is used for this pretreatment in essence.

The undyed pretreated polyester fibers (C), yarns (E) and textile fabrics (F) are dyed by treating them with a formulation comprising at least water and a dye. An aqueous formulation for dyeing textile materials is also referred to as "liquor" by a person skilled in the art.

In one embodiment, the dying operation g) or IV) takes place at a temperature below 130° C., preferably at ≤120° C., more preferably ≤110° C., even more preferably ≤100° C. and especially preferably ≤90° C.

Preferably, the dispersion color comprises exclusively water as well as the formulation and the disperse dye. However, small amounts of water-miscible organic solvents can additionally be present. Examples of such organic solvents comprise monohydric or polyhydric alcohols, for example methanol, ethanol, n-propanol, isopropanol, ethylene glycol, propylene glycol or glycerol. Ether alcohols may also be concerned. Examples comprise monoalkyl ethers of (poly)ethylene or (poly)propylene glycols such as ethylene glycol monobutyl ether. The amounts of solvents other than water, however, should generally not exceed 20% by weight, preferably 10% by weight and more preferably 5% by weight, based on the sum total of all the solvents of the formulation or to be more precise liquor.

All dyes known in principle for dyeing PES fibers (polyester fibers (C)), yarns (E) and textile fabrics (F) and suitable for dyeing polyester fibers can be used as dyes in the formulation. In the process of the present invention, more particularly, dyeing operation g) or (IV) preferably utilizes a disperse dye and optionally a dispersing assistant.

The term "disperse dye" is known to a person skilled in the art. Disperse dyes are dyes which have a low solubility in water and which are used in dispersed, colloidal form for dyeing, more particularly for dyeing fibers and textile materials. In principle any desired disperse dyes can be used for performing the invention. These may contain various chromophores or mixtures of chromophores. Azo dyes or anthraquinone dyes may be concerned in particular. Quinophthalone, naphthalimide, naphthoquinone or nitro dyes may further be concerned. The nomenclature of dyes is known to a person skilled in the art. The complete chemical formulae are discernible from pertinent textbooks and/or databases. Further details concerning disperse dyes and further examples are also outlined at length for example in "Industrial Dyes", Editor Klaus Hummer, Wiley-VCH, Weinheim 2003, pages 134-158.

It will be appreciated that it is also possible to use mixtures of various disperse colors. Mixed-shade colors are obtainable in this way. Preference is given to disperse colors that have good fastnesses and enable trichromatic dyeing.

The amount of (disperse) dyes in the formulation is decided by a person skilled in the art according to the intended purpose.

The formulation, in addition to solvents and dyes, may comprise still further auxiliaries. Examples comprise typical textile auxiliaries such as dispersing and leveling agents, acids, bases, buffer systems, surfactants, complexing agents, defoamers or stabilizers against UV degradation. A UV absorber may preferably be used as an auxiliary.

Dyeing is preferably carried out using a weakly acidic formulation, for example having a pH in the range from 4.5 to 6, preferably from 5 to 5.5.

All types of textile materials (D) can be produced from the polyester fibers (C), yarns (E) and textile fabrics (F) produced by the process of the present invention. The term "textile materials" (D) is to be understood as comprising all materials in the entire manufacturing chain of textiles. The term comprises any kind of textile end products such as, for example, clothing of any kind, home textiles such as carpets, drapes, blankets or furnishings or industrial textiles for technical or commercial purposes or applications in the home such as for example cloths or wipes for cleaning or umbrella fabrics. The term further comprises the starting materials, i.e., fibers for textile use such as filaments or staple fibers and also semi-finished or intermediate articles, for example yarns, wovens, knits, fibrous nonwoven webs or nonwovens. The invention also comprises fillers and staples for textiles such as for example cushions or else stuffed animals, or as packaging material. Processes for producing textile materials from yarns and/or fibers are known in principle to a person skilled in the art.

The textile materials (D) can have been produced exclusively from the polyester compositions used according to the present invention. But it will be appreciated that they can also be used in combination with other materials, such as natural fibers for example. A combination can take place at various fabrication stages. For instance, filaments composed of a plurality of polymers in a defined geometric arrangement can be produced at the melt-spinning stage. At the yarn-producing stage, fibers composed of other polymers can be incorporated, or fiber blends can be produced from staple fibers. It is further possible to process different yarns together and finally it is also possible for wovens, knits or the like that comprise the polyester compositions of the present invention to be bonded to chemically different wovens. Textile materials (D) which are preferred according to the present invention comprise more particularly textile materials for sports and leisure apparel, carpets or fibrous nonwoven webs.

Treating the textile materials (D) with the aqueous dye formulation can be effected by means of customary dyeing processes, for example by immersion into the formulation (for example by the exhaust process), spraying the formulation, printing or applying the formulation by means of suitable apparatus. Continuous or batch processes can be concerned. Dyeing apparatuses are known to a person skilled in the art. Dyeing can be effected for example batchwise using reel becks, yarn dyeing apparatus, beam dyeing apparatus or jets, or continuously in slop-padding, nip-padding, spraying or foam application processes using suitable drying and/or fixing means.

The weight ratio of the dye formulation to textile materials (D) (also known as "liquor ratio") and also more particularly of the dye itself to the textile materials is decided by a person skilled in the art according to the intended purpose. The general case is a weight ratio of dye formulation/textile materials (D) in the range from 5:1 to 50:1, preferably 10:1 to 50:1 and likewise preferably 5:1 to 20:1, more preferably 10:1, based on the textile material, without any intention that the invention shall be restricted to this range. The amount of dye in the formulation is preferably about 0.5% to 5% by weight, preferably 1% to 4% by weight, based on the textile material.

According to the present invention, the textile materials are heated to a temperature above the glass transition temperature Tg of the polyester fibers but below their melting temperature, during and/or after the treatment with the dye formulation. This may preferably be effected by heating the entire formulation to the temperature in question and dipping the textile materials into the formulation. The glass transition temperature Tg of the polyester fibers depends on the identity of the polymer composition used and can be measured by methods known to a person skilled in the art.

However, the textile materials can also be treated with the formulation at a temperature below Tg, optionally dried and subsequently heated to a temperature above Tg. It will be appreciated that combinations of the two approaches are also possible.

The temperature involved in the treatment naturally depends on the identity of the polyester composition used and of the dye used. It will be found advantageous to use temperatures of 90 to 145° C., preferably 95 to 130° C.

The duration of the dyeing operation is determined by a person skilled in the art according to the nature of the polymer composition, formulation and the dyeing conditions. It is also possible to vary the temperature as a function of the treatment time. For instance, the aqueous liquor can initially be heated to 100° C. at intervals of 2 to 3° C./min each, then maintained at 100° C. for about 25 to 35 minutes and then cooled down at an interval of 2 to 3° C./min in each case to 70° C. and then to 30° C.

Dyeing may be followed by a conventional aftertreatment, for example with laundry detergents or oxidatively or reductively acting afterclearing agents or fastness improvers. Aftertreatments of this type are known in principle to a person skilled in the art. A possible afterwash can be carried out with hydrogensulfite and NaOH at 70° C. for example, followed by hot water and cold rinsing and acidulating.

In an alternative embodiment of the invention, the undyed textile materials (D) can also be printed. To be useful for printing, a textile material (D) must of course have sufficient area. Fibrous nonwoven webs, nonwovens, wovens, knits or self-supporting films can be printed for example. Wovens are preferably used for printing.

Processes for printing textile materials (D) with disperse dyes for example are known in principle to a person skilled in the art.

Dyeing and printing can be combined with each other, for example by first dyeing a textile material (D) in a certain color and then printing it with a pattern, logo or the like.

The present invention further provides for the use of the fibers (C), yarns (E) and textile fabrics (F) produced by the hereinabove exhaustively described process of the present invention in the manufacture of textile materials (D) and textile sheet bodies, more particularly in the manufacture of fibers, yarn, fillers, staples, wovens, knits, fibrous nonwoven webs, nonwovens, decorative and industrial textiles and also carpets.

In an advantageous embodiment of the invention, the polyester fibers (C) are used in the manufacture of dyed or undyed blended or unblended fibers for apparel, home or utility textiles.

The examples which follow illustrate the invention.

Example 1: Production of a Polyester Fiber (C) and Processing to a Yarn (E) Comprising Polyester-Containing Additives (B)

To perform the tests, a polyester (granular PBT) (A) [X %] was mixed with Y % of a polyester-containing additive (B) consisting of the monomers 1,4-butanediol (50 mol %), adipic acid (25 mol %) and terephthalic acid (25 mol %, prepared as per WO 98/12242), and extruder melted. The homogeneous melt was subsequently extruded through the hole dies and the polyester fiber (C) was obtained in the form of filaments which were wound up.

The spinning machine used contained a 24 hole die (24/0.2) with a normal screen (50μ). All regulators were set to a temperature of 280° C. and die pressure was 28-32 bar. The extruder speed setting was 50 rpm, the godet speed was 300 rpm and the windup speed was 600 rpm.

The draw ratio was 1:2 (50/100 m/min) and the hotplate temperature was 100° C. The spun polyester fibers (C) were subsequently spun in a second spinning operation to form a yarn (E).

Table 1 shows the ratios used for polyester (PBT) (A) to polyester-containing additive (B) and the resulting as-drawn linear density of the yarn (E).

TABLE 1

| Run No. | A [%] | B [%] | As-drawn linear density [dtex] |
|---|---|---|---|
| 1 | 100 | — | 125 |
| 2 | 98 | 2 | 122 |
| 3 | 96 | 4 | 127 |
| 4 | 92 | 8 | 127 |

The yarns (E) were then knitted up on a circular knitting machine to form a textile fabric (F).

Example 2: Pretreatment Prior to Dyeing

Prior to dyeing, the textile fabric (F) was pretreated with Kieralon Jet B® conc. (1 g/L) and a liquor ratio of 20:1 at 60° C. in a standard apparatus for 20 minutes.

Example 3: Dyeing

The dyeings were carried out by leaving the knitted pieces produced as described above in the presence of commercially available disperse dyes (for example DianixDeepRed SF) in an amount of 2% by weight, based on the amount of the undyed textile used, and also 1 g/L of Basojet XP® as CO color additive in demineralized water at from pH 5 to pH 5.5 in a standard dyeing apparatus from initially 30° C. during 30 to 40 minutes to 100° C. (or 115° C.).

The ratio of the volume of the treatment bath in liters to textile fabric (F), i.e., polyester-containing knitted fabric (dry), in kilograms, i.e., the so-called liquor ratio, was 10:1 in the aqueous medium.

After dyeing, the temperature was lowered at rates of 2.5° C./min to 70° C. and then to 30° C.

The fabrics were reduction cleared by washing with 4 g/L of hydrogensulfite and 2 g/L of NaOH (100%) at 70° C. for 10 minutes, then rinsed with hot and cold water and acidulated with acetic acid.

Table 2 lists the various blend fabrics, the dyeing temperature and the color strengths (washed and unwashed).

Runs 1, 2, 3 and 4, when viewed in comparison, show that the color strength increases with increasing content of (B) (polyester-containing additive). At 8% of (B), almost the same color strength is achieved as in run 6 (=prior art; 114% vs. 112%, which is within the margin of error). At a dyeing temperature of 100° C., the additized version achieves virtually the same color strength as unadditized PBT at 130° C. This demonstrates that dyeing in an atmospheric system at 100° C. is possible and gives similar results to previously at 130° C.

TABLE 2

Dyed knits 1, 5 and 6 (100% PES material) were used as controls at 100% color strength.

| Run No. | A [%] | B [%] | Disperse dye | Dyeing temperature [° C.] | Color strength unwashed | Color strength washed | compared to |
|---|---|---|---|---|---|---|---|
| 1 | 100 | — | 2% Dianix Deep SF | 100 | 100% | 100% | 100% |
| 2 | 98 | 2 | 2% Dianix Deep SF | 100 | to 1 100.33% | to 1 100.56% | 100% |
| 3 | 96 | 4 | 2% Dianix Deep SF | 100 | to 1 110.23% | to 1 102.37% | 100% |
| 4 | 92 | 8 | 2% Dianix Deep SF | 100 | to 1 112.13% | to 1 111.10% | 100% |
| 5 | 100 | — | 2% Dianix Deep SF | 115 | 100% | 100% | to 1 111.55% |
| 6 | 100 | — | 2% Dianix Deep SF | 130 | 100% | 100% | to 1 114.64% |

Example 4: Washfastness Testing

Washfastness was tested to "ISO 105-C06-A1S, 40° C." (without steel balls). Runs 1 to 6 were washed and tested for water fastness. The runs are numbered in line with the runs shown in Table 2.

TABLE 3

| Run No. | Dye | Dyeing temperature [° C.] | Wool [Wo] | Polyacrylate [PAC] | Polyester [PES] | Polyamide [PA] | Cotton [CO] | Viscose [VIS] | Xenon light-fastness |
|---|---|---|---|---|---|---|---|---|---|
| 1 | Dianix Deep Red SF | 100 | 4 | 5 | 4-5 | 4 | 4-5 | 5 | >5 |
| 2 | Dianix Deep Red SF | 100 | 4 | 5 | 4-5 | 4 | 4-5 | 5 | |
| 3 | Dianix Deep Red SF | 100 | 4 | 5 | 4-5 | 4 | 4-5 | 5 | |
| 4 | Dianix Deep Red SF | 100 | 4 | 5 | 4-5 | 4 | 4-5 | 5 | >5 |
| 5 | Dianix Deep Red SF | 115 | 4 | 5 | 4-5 | 4 | 4-5 | 5 | >5 |
| 6 | Dianix Deep Red SF | 130 | 4 | 5 | 4-5 | 4 | 4-5 | 5 | >5 |

Washfastness and lighffastness of the textile materials were rated on a scale from 1 to 5 to assess bleeding of the dyed substance and hence the staining of the textiles wool, polyacrylate, polyester, polyamide, cotton and viscose. The higher the value, the lower the amount of staining of the various textiles, which points to a lower amount of bleeding of the dyed polyester fiber knit.

The dyed substance is absolutely washfast in relation to PAC and VIS but also PES and CO, and merely Wo and PA were minimally stained.

Example 5

Polyethylene terephthalate having an intrinsic viscosity (I.V.) of 0.65 dl/g was processed similarly to example 1 with and without addition of 5.5% by weight of polyester-containing additive (B) formed from the monomers 1,4-butanediol (50 mol %), adipic acid (25 mol %) and terephthalic acid (25 mol %) (prepared as per WO 98/12242) to form polyester fibers (C). One multifilament polyester fiber was produced with additive (B) (inventive) and one multifilament polyester fiber was produced without additive (comparative). The inventive and noninventive fibers produced were partially oriented to form POY (partially oriented yarn) and fully drawn and intermingled (FDY=fully draw yarn). The POY and FDY processes are known to a person skilled in the art and can be reviewed in, for example, Hans-J. Koslowski. "Dictionary of Man-made fibers", Second edition, Deutscher Fachverlag, 2009. Table 4 lists the as-drawn linear densities for the four yarns. Subsequently, the yarns (E) were knitted up on a circular knitting machine to produce a textile fabric (F) in each case.

TABLE 4

| Example | Yarn production | As-drawn dtex |
|---|---|---|
| 5-1 (comparative) | POY | 289 |
| 5-2 (inventive) | POY | 288 |
| 5-3 (comparative) | FDY | 169 |
| 5-4 (inventive) | FDY | 169 |

The polyester fibers thus obtained were then dyed with different dyes. Commercially available dyes from DyStar Textilfarben GmbH & Co Deutschland were used: the red dye was Dianix Rubin CC, the yellow dye was Dianix Yellow CC, the blue dye was Dianix Blue CC. The dye was in each case used in an amount of 2% by weight, based on the amount of textile to be dyed, and also 1 g/L of Basojet XP® as co color additive in demineralized water. For dyeing, the temperature was raised at a heating rate of 2.5° C./min to 100, 105 or 130° C. and maintained at this temperature for 40 min only. This was followed by cooling to 70° C. at a cooling rate of 2.5° C./min. This is followed by a less severe reduction clear with alkali and a subsequent neutralization. These aftertreatment processes are known to a person skilled in the art.

The color strength of the dyed textiles was determined visually. The results are shown in table 5. The depth of shade achieved at the particular dyeing temperature is expressed based on the dyeing result for the purely polyester fiber at 130° C.

TABLE 5

| | | Depth of shade at dyed temperature | | |
|---|---|---|---|---|
| Fiber of example | Color | 100° C. | 105° C. | 130° C. |
| 5-1 (comparative) | yellow | 5-10% | 10-20% | 100% |
| 5-2 (inventive) | yellow | 90% | 95% | |
| 5-1 (comparative) | red | 5-10% | 10-20% | 100% |
| 5-2 (inventive) | red | 80% | 90% | |
| 5-1 (comparative) | blue | 5-10% | 10-20% | 100% |
| 5-2 (inventive) | blue | 60% | 70% | |
| 5-3 (comparative) | yellow | 5-10% | 10-20% | 100% |
| 5-4 (inventive) | yellow | 90% | 95% | |
| 5-3 (comparative) | red | 5-10% | 10-20% | 100% |
| 5-4 (inventive) | red | 80% | 90% | |
| 5-3 (comparative) | blue | 5-10% | 10-20% | 100% |
| 5-4 (inventive) | blue | 60% | 70% | |

The results in table 5 show clearly that textiles produced using the process of the present invention have a distinctly higher color strength at lower dyed temperatures than the comparative fibers, which do not contain any polyester-containing additive and have to be dyed at higher temperatures to achieve a satisfactory dyed result.

Example 6

The color fastness of the textiles composed of the fibers 5-1 to 5-4 was tested in various test methods. In each case, a standardized test cloth, having side-by-side stripes composed of triacetate fibers, cotton, polyamide fibers, polyester fibers, polyacrylic fibers and viscose fibers, was in each case sewn onto a specimen of the dyed textile and subjected to the test. Subsequently, the staining of the various fiber varieties present in the sewn-on standard fabric specimen was assessed by visual inspection. Different test methods were used.

The sublimation test as per ISO 105 PO1 determines the fastness to dry heat setting (with the exception of ironing) of the dyed sheet body. Perspiration fastness (acid) as per ISO 105 E04 and perspiration fastness (alkaline) as per ISO 105 E04 determines the change in the dye caused by perspiration. Also tested were the fastness to washing at 60° C. and also to rubbing as per ISO 105 X12 according to ISO 105 PO1. The results are summarized in table 6, Assessment is on a scale from 1 to 5, the higher the value, the lower the staining of the fabric in the standard specimen. From this, inferences can be drawn about the color fastness of the particular textile tested.

TABLE 6

| Test method | Multifiber | Textile of 5-2 (inventive) | Textile of 5-1 (comparative) | Textile of 5-4 (inventive) | Textile of 5-3 (comparative) |
|---|---|---|---|---|---|
| Sublimation | Triacetate | 4 | 4 | 4 | 4 |
| ISO 105 PO1 | Cotton | 4 | 4 | 4 | 4 |
| | Polyamide | 3/4 | 3 | 3/4 | 3 |

TABLE 6-continued

| Test method | Multifiber | Textile of 5-2 (inventive) | Textile of 5-1 (comparative) | Textile of 5-4 (inventive) | Textile of 5-3 (comparative) |
|---|---|---|---|---|---|
| | POLYESTER | 3 | 2/3 | 3 | 3 |
| | Polyacrylic | 3/4 | 3 | 3/4 | 3 |
| | Viscose | 3/4 | 3 | 3/4 | 3 |
| | Change in hue | 3/4 | 4 | 4 | 4 |
| Perspiration fastness (acid) ISO105 E04 | Triacetate | 4/5 | 4/5 | 4/5 | 4/5 |
| | Cotton | 4/5 | 4/5 | 4/5 | 4/5 |
| | Polyamide | 4/5 | 4/5 | 4/5 | 4/5 |
| | POLYESTER | 4/5 | 4/5 | 4/5 | 4/5 |
| | Polyacrylic | 4/5 | 4/5 | 4/5 | 4/5 |
| | Viscose | 4/5 | 4/5 | 4/5 | 4/5 |
| | Change in hue | 4 | 4 | 4 | 4 |
| Perspiration fastness (alkaline) ISO 105 E04 | Triacetate | 4/5 | 4/5 | 4/5 | 4/5 |
| | Cotton | 4/5 | 4/5 | 4/5 | 4/5 |
| | Polyamide | 4/5 | 4/5 | 4/5 | 4/5 |
| | POLYESTER | 4/5 | 4/5 | 4/5 | 4/5 |
| | Polyacrylic | 4/5 | 4/5 | 4/5 | 4/5 |
| | Viscose | 4/5 | 4/5 | 4/5 | 4/5 |
| | Change in hue | 4 | 4 | 4 | 4 |
| Washing at (60° C.) to ISO 105 C06 C1S | Triacetate | | | 4 | 4 |
| | Cotton | | | 4 | 4 |
| | Polyamide | | | 3 | 3/4 |
| | POLYESTER | | | 4 | 4 |
| | Polyacrylic | | | 4 | 4 |
| | Viscose | | | 4 | 4 |
| | Change in hue | | | 4 | 4 |
| Rubbing ISO 105X12 to ISO 105 PO1 | moist | 4/5 | 4/5 | 4/5 | 4/5 |
| | dry | 4/5 | 4/5 | 4/5 | 4/5 |

As is clearly apparent from table 6, the textiles comprising component (B) which are dyed according to the present invention at lower temperatures show similar color fastness properties to the textiles composed of purely PET, which were dyed at 130° C.

Hence the purposes of the invention were achieved:

production of an easily spinnable polyester fiber (C)

production of a nonscratching, soft polyester fiber (C)

atmospheric dyeing of produced polyester fiber (C) possible (no pressure vessels needed)

elimination of the need to use extraneous carriers energy saving due to lower water temperature in dyeing process time saving because heating up and cooling down costs a lot of time inexpensive very good dyeing outcome high wash- and lightfastness

The invention claimed is:

1. A process for producing dyed polyester fibers (C), dyed yarn (E) and/or dyed textile fabric (F) from the components a) 80% to 99% by weight, based on the sum total of all the constituents of the fibers, of at least one terephthalate polyester (A), b) 1% to 20% by weight, based on the sum total of all the constituents of the fibers, of at least one polyester-containing additive (B) obtainable from the monomers m m1) aliphatic 1,ω-diol, m2) aliphatic 1,ω-dicarboxylic acid, m3) aromatic 1,ω-dicarboxylic acid, and at least one chain extender (V) selected from the group consisting of tartaric acid, citric acid, malic acid, trimethylolpropane, trimethylolethane, pentaerythritol, polyether triols, glycerol, trimesic acid, trimellitic acid, trimellitic anhydride, pyromellitic acid, pyromellitic dianhydride, hydroxyisophthalic acid and 1,6-hexamethylene diisocyanate, wherein the glass transition temperature of the polyester-containing additive (B) is between 40° C. and −20° C. and c) optionally at least one component (G)

comprising the steps of

I) mixing the components (A), (B) and, if used, one or more components (G),

II) producing polyester fibers (C) from the mixture obtained in step I),

III) optionally further processing the polyester fibers (C) into yarn (E) and/or textile fabric (F), and IV) dyeing the polyester fibers (C), the yarn (E) and/or the textile fabric (F) at a temperature of <130° C., wherein the at least one terephthalate polyester (A) is a polyethylene terephthalate and wherein the aliphatic 1,ω-diol (m1) is 1,4-butandiole and the aliphatic 1,ω-dicarboxylic acid (m2) is adipic acid and the aromatic 1,ω-dicarboxylic acid (m3) is terephthalate acid and wherein the at least one component (G) is selected from the group consisting of processing assistants, additives, UV stabilizers, photostabilizers, thermal stabilizers, dyes, pigments, flame retardants, antioxidants, plasticizers, metal oxides, optical brighteners and fillers.

2. The process according to claim 1, wherein step II) comprises the mixture obtained in step I) being melted in an extruder, extruded through spinneret dies and wound up.

3. The process according to claim 1, wherein step III) comprises the polyester fibers (C) being spun into a yarn (E).

4. The process according to claim 3, wherein step III) comprises the polyester fibers (C) and/or the yarn (E) being further processed into a textile fabric.

5. The process according to claim 1, wherein the polyester fibers (C), the yarn (E) and/or the textile fabric (F) are treated with a stabilizing emulsifier before the dyeing.

6. The process according to claim 1, wherein the monomers m1):m2):m3) are present in a molar ratio of 2:1:1.

7. The process according to claim 1, wherein up to 7% by weight of the at least one chain extender (V) is used.

8. The process according to claim 1, wherein the polyester-containing additive (B) has a number average molecular weight Mn in the range from 50 000 to 180 000 g/mol.

9. The process according to claim 1, wherein the dyeing (IV) utilizes a disperse dye and optionally a dispersing assistant.

10. The process according to claim 1, wherein the polyester-containing additive (B) has a number average molecular weight Mn in the range from 50 000 to 300 000 g/mol.

11. The process according to claim 1, wherein in step (IV) dyeing the polyester fibers (C), the yarn (E) and/or the textile fabric (F) is conducted at a temperature of ≤120° C.

12. The process according to claim 1, wherein the dying temperature in step IV is <130° C.

13. The process according to claim 1, wherein the dying temperature in step IV is ≤90° C.

14. A process according to claim 1, further comprising manufacturing textile materials (D) from the dyed polyester fiber (C), dyed yarn (E) and/or dyed textile fabric (F).

15. A process for producing dyed polyester fibers (C), dyed yarn (E) and/or dyed textile fabric (F) from the components a) 80% to 99% by weight, based on the sum total of all the constituents of the fibers, of at least one terephthalate polyester (A), wherein the terephthalate polyester (A) is a polyethylene terephthalate, b) 1% to 20% by weight, based on the sum total of all the constituents of the fibers, of at least one polyester-containing additive (B) obtainable from the monomers m m1) aliphatic 1, ω-diol, which is 1,4-butanediol, m2) aliphatic 1, ω-dicarboxylic acid, which is adipic acid, m3) aromatic 1, ω-dicarboxylic acid which is terephthalic acid, and at least one chain extender (V) selected from the group consisting of tartaric acid, citric acid, malic acid, trimethylolpropane, trimethylolethane, pentaerythritol, polyether triols, glycerol, trimesic acid, trimellitic acid, trimellitic anhydride, pyromellitic acid, pyromellitic dianhydride, hydroxyisophthalic acid and 1,6-hexamethylene diisocyanate, wherein the glass transition temperature of the polyester-containing additive (B) is between −40° C. and −20° C., and c) optionally at least one component (G)

comprising the steps of

I) mixing the components (A), (B) and, if used, one or more components (G),

II) producing polyester fibers (C) from the mixture obtained in step I),

III) optionally further processing the polyester fibers (C) into yarn (E) and/or textile fabric (F), and IV) dyeing the polyester fibers (C), the yarn (E) and/or the textile fabric (F) at a temperature of <130° C., wherein the at least one component (G) is elected form the group consisting of processing assistants, additives, UV stabilizers, photostabilizers, thermal stabilizers, dyes and pigments, flame retardants, antioxidants, plasticizers, metal oxides, optical brighteners and fillers, wherein the dye in step IV) is elected from the group consisting of azo dyes, anthraquinone dyes, quinophthalone dyes, naphthalimide dyes, napthoquinone dyes, nitro dyes and mixtures thereof.

16. The process according to claim 15, wherein the dying temperature in step IV is <130° C.

17. The process according to claim 15, wherein the dying temperature in step IV is ≤90° C.

* * * * *